US005368694A

United States Patent [19]

Rohlf et al.

[11] Patent Number: 5,368,694

[45] Date of Patent: Nov. 29, 1994

[54] PITCH REDUCTION ON PAPER MACHINE FORMING FABRICS AND PRESS FABRICS

[75] Inventors: Evan V. Rohlf, West Dundee, Ill.; Fletcher Walley; Richard J. Wagner, both of Dauphin Island, Ala.

[73] Assignee: W. R. Grace & Co.-Conn., New York, N.Y.

[21] Appl. No.: 981,574

[22] Filed: Nov. 25, 1992

[51] Int. Cl.[5] ..... D21H 21/02

[52] U.S. Cl. ..... 162/199; 162/5; 162/164.5; 162/166; 162/168.2; 162/DIG. 4; 162/158; 162/164.1; 162/164.3; 162/168.1

[58] Field of Search ..... 162/199, DIG. 4, 164.3, 162/164.6, 168.2, 5, 166, 164.5, 168.5, 164.1, 158, 168.1

[56] References Cited

U.S. PATENT DOCUMENTS 4,184,912 1/1980 Payton ..... 162/72
4,861,429 8/1989 Barnett et al. ..... 162/199
4,956,051 9/1990 Moreland ..... 162/199
4,964,955 10/1990 Lamar et al. ..... 162/199
4,995,944 2/1991 Aston et al. ..... 162/199

OTHER PUBLICATIONS

Thord Hassler, "Pitch Deposition in Papermaking and the Function of Pitch-Control Agents", Jun. 88, TADPI Journal, pp. 195–201.

*Primary Examiner*—Peter Chin
*Assistant Examiner*—Dean T. Nguyen

[57] ABSTRACT

A method for controlling or inhibiting the deposition of pitch derived from aqueous pulp suspensions having a neutral or cationic soluble charge onto paper machine equipment surfaces which contact the pulp, comprising a) contacting the pulp with an anionic polymer in an amount sufficient to maintain an anionic charge in the pulp and b) contacting the paper machine equipment surfaces with a cationic polymer in an amount sufficient to inhibit the deposition of pitch deposits thereon.

17 Claims, No Drawings

PITCH REDUCTION ON PAPER MACHINE FORMING FABRICS AND PRESS FABRICS

FIELD OF THE INVENTION

This invention relates to the control of pitch on surfaces of paper making machines which are prone to pitch deposits, and more particularly for a method of controlling pitch in a papermaking machine by treating certain aqueous pulp suspensions of a paper making system with an anionic chemical treatment and treating the paper machine surfaces with a cationic chemical treatment to effectively reduce pitch or stickies deposition thereon.

BACKGROUND OF THE INVENTION

Pulp and papermaking operations have always been concerned with the problem of organic deposits. These organic deposits comprise various sticky materials which may originate from the anionic resinous materials present in the wood from which the paper is made, or may originate from various inks or adhesive materials which are present in recycled paper which is frequently being used in current paper making processes. The organic deposit material originating naturally from the wood is referred to as "pitch" whereas the organic deposit material originating from recycled fiber is referred to as "stickies". However, for purposes of this invention, the term "pitch" shall include not only naturally occurring pitch particles derived from paper pulp, but also any synthetic sticky materials derived from recycled fiber and which form insoluble organic deposits on paper making equipment surfaces.

Pitch is known to accumulate at various points in the papermaking system. For example, it is known to block the paper machine felts and thus hinder drainage of the paper web. It can adhere to the wires or drying cylinders causing it to pick holes in the paper. It may also deposit on press rolls, dryer fabric or other like equipment surfaces which come into direct or indirect contact with the aqueous pulp suspension, paper sheet or paper machine felts. In fact, all paper machine fabrics and many of the rolls which contact the fabrics or paper sheet will, from time to time, accumulate pitch deposits.

Many materials and techniques have been used in an attempt to eliminate these problems. A traditional technique to control these deposits has been to shut down the production equipment to clean off the affected equipment parts with various solvents. Alternative methods involve the treatment of the aqueous pulp system with various chemical dispersants including inorganic dispersants such as talc or anionic dispersants. These dispersants are of course added in amounts which are effective to disperse the pitch particles in the aqueous pulps suspensions. However, the use of these conventional dispersants has been generally ineffective, particularly in closed papermaking systems where the system water is continuously recycled and results in the accumulation and build-up of pitch in the system (known as cycling up). In such closed systems the pitch particles must be removed from the system water in a controlled way without being allowed to accumulate on the paper machine equipment such as the felts, rolls, or the pipe works.

One such method of controlled removal is to spray aqueous formulations of cationic polymers and cationic surfactants onto paper machine surfaces which are prone to pitch deposit formations to reduce the build-up of these deposits. However, this method has not been completely successful for controlling deposits on paper machines or other related paper making operations which use pulp suspensions containing relatively high dosages of cationic wet strength resins, cationic sizing agents, cationic dyes or other cationic treatment agents which are present in amounts which provide a neutral or cationic soluble charge to the normally anionic soluble charge of the aqueous pulp suspension.

SUMMARY OF THE INVENTION

It is an object of this invention to provide a method for controlling or inhibiting the deposition of pitch derived from an aqueous pulp suspension having a neutral or cationic soluble charge onto paper machine equipment surfaces which are prone to pitch deposits.

In accordance with the present invention, there has been provided a method for controlling or inhibiting the deposition of pitch derived from aqueous pulp suspensions having neutral or cationic soluble charge onto paper machine equipment surfaces comprising a) contacting the aqueous pulp suspension with an anionic polymer or anionic surfactant in an amount sufficient to maintain an anionic soluble charge in the aqueous pulp suspension, and b) contacting the paper machine equipment surfaces which contact the pulp with a cationic polymer and/or cationic surfactant in an amount sufficient to inhibit the deposition of pitch deposits thereon.

DETAILED DESCRIPTION

The present invention is directed to a method for controlling the deposition of pitch onto paper machine equipment surfaces which are prone to pitch deposits. These equipment surfaces generally include those which contact the aqueous pulp system of the paper machine. As used herein, the terminology "aqueous pulp suspension" refers not only to the pulp systems being fed directly onto the sheet forming wires, but also includes the white water systems as well as any other aqueous systems in a papermaking machine which contain pulp fibers. Typical areas prone to pitch deposition include, but are not limited to, forming wires, felts, headbox, press rolls, disk filters, couch rolls, etc.

In general, most aqueous pulp suspensions will have an anionic soluble charge due to the presence of anionic resinous materials which are naturally present in wood or from adhesives in recycled paper as well as from other anionic materials which may be present in the aqueous pulp suspension and which are carried over into the pulping and papermaking systems. However, some aqueous pulp suspensions have a neutral or cationic soluble charge. As used herein, the terminology "neutral or cationic soluble charge" refers to a soluble charge in the range of from about $-10$ μeq/l to $+80$ μeq/l. Pulp suspensions having a neutral or cationic soluble charge contain relatively high dosages of cationic wet strength resins, cationic sizing agents, cationic dispersants, cationic dyes, or other cationic treatment components in amounts sufficient to change the soluble charge of the aqueous pulp suspension from an anionic soluble charge to a neutral or cationic soluble charge. The neutral or cationic charge is generally caused by these various cationic additives which are not 100% retained by the sheet. These additives are added to the aqueous pulp suspension to impart special properties to the paper made, and are most often used in the manufacture of tissue paper. While the neutral or cationic soluble charge of an aqueous pulp suspension is typically from −10 to +50 μeq/l; in closed papermaking systems, i.e., where the whitewater system is continuously recycled, the amount of cationic treatment component "cycles up" and can often result in a cationic soluble charge as high as 80 μeq/l.

It has now been discovered that pitch deposition can be inhibited in papermaking systems having an aqueous pulp suspension with a neutral or cationic soluble charge by the steps of 1) adding anionic polymers, anionic surfactants, or mixtures thereof, to the aqueous pulp system, in an amount sufficient to change the neutral or cationic soluble charge to an anionic soluble charge, and 2) applying to paper machine equipment surfaces which are prone to pitch deposits (i.e., those equipment surfaces which are in contact with the aqueous pulp suspension) cationic polymers, cationic surfactants or mixtures thereof in amounts effective to inhibit pitch deposits.

The soluble charge of an aqueous pulp suspension was not, heretofore, recognized as a critical variable for controlling pitch deposits. Moreover, it was surprising and unexpected that the addition of anionic polymers or anionic surfactants to a pulp suspension having a neutral or cationic soluble charge, in amounts effective to maintain an anionic soluble charge therein, would not negatively affect the performance of the cationic treatment components in the aqueous pulp suspension. For example, in the manufacture of tissue paper, the use high dosages of cationic wet strength resins is necessary to treat the pulp suspension. The addition of anionic polymers and/or anionic surfactants of this invention to this type of pulp suspension, in amounts effective to change the soluble charge from cationic to anionic, did not result in any diminution in tissue paper quality. That is, there was no apparent negative interaction between the cationic wet strength resins and the relatively high dosages of anionic polymers or anionic Surfactants which were added to the aqueous pulp suspension in amounts sufficient to change the soluble charge from cationic to anionic.

Suitable anionic polymers and anionic surfactants for use in this invention include any anionic polymer or anionic surfactant which is capable of providing and maintaining an anionic soluble charge in the aqueous pulp suspension and which does not negatively affect the characteristics of the final paper sheet. The molecular weights of the anionic polymers and anionic surfactants are not, per se, critical to the invention, provided of course that these polymers and surfactants are water soluble. For purposes of this invention, the terminology "water soluble" shall include not only those polymers that are readily soluble in water, but also those polymers which are considered "water-dispersible", i.e. polymers which may be first solubilized in a water-miscible solvent and may then be readily added to an aqueous system without precipitating out of solution.

In general, the anionic polymers will have molecular weights from 1000 to 500,000, preferably from 1000 to 100,000, and most preferably from 20,000 to 50,000. Specific examples of suitable anionic polymers include, but are not limited to water soluble or water dispersible aliphatic or aromatic polymers, and are preferably "sulfonated and/or hydroxylated polymeric compounds such as kraft lignins, lignosulfonates, polynaphthalene sulfonates, tannins, sulfonated tannins, and the like and mixtures thereof. The anionic polymers of this invention can be used either in the free acid form or in the form of water soluble salts thereof.

Suitable anionic surfactants include, but are not limited to water soluble or water dispersible alkylaryl sulfonates which are commercially available under the Grademarks Calcinate C-70 from Witco Corp., Alkasurf AG from Alkaril Chemicals, Ltd., and Emulsogen HFIT from Hoeschst Celanese Corp.; sulfonated amines and amides which are commercially available under the trademarks Calimulse PRS from Pilot Chemicals Co. and Monamine 779 from Mona Industries; carboxylated alcohol ethoxylates which are commercially available under the trademarks Miranate LEC from Miranol Inc. and Sandopan DTC from Sandoz Chemicals Corp.; diphenyl sulfonate derivatives which are commercially available under the trademarks Calfax from Pilot Chemicals Co. and Dowfax 2EP from Dow Chemical Co.; lignin and lignin derivatives which are commercially available under the trademarks Lignosite 231 from Georgia Pacific Corp., Indulin AT from Westvaco Corp. and Lignosol SFX from Daishowa Chemicals Inc.; phosphate esters which are commercially available under the trademarks DeSophos 14 DNP from DeSoto Inc., Triton H-66 from Rohm and Haas Co. and Maphos 15 from PPG/Mazer; protein-based surfactant which is commercially available under the trademarks Lamepon S from Henkel Corp. and Amiter LGOD from Ajinomoto USA, Inc.; soaps of process rosin which are commercially available under the trademarks Emkapol PO-18 from Emkay Chemical Co. and Indulin HFRS Series from Westvaco Corp.; sulfates and sulfonates of ethoxylated alkyl phenols which are "commercially available under the trademarks Alipal CO-436 from Rhone-Poulenc and Polystep B-1 from Stepan Company; sulfates of ethoxylated alcohols which are commercially available under the trademarks Carsonol SES-S from Lonza Inc. and Witcolate 1259 from Witco Corp. and sulfonates of naphthalene and alkyl naphthalene which are commercially available under the trademarks Nekal BA-77 from Rhone-Poulenc and Alkanol XC from DuPont Co.

The anionic polymers, anionic surfactants, or mixtures thereof are typically supplied as liquid compositions comprising aqueous solutions of the polymer, surfactant or mixture thereof. Polymer concentrations in the compositions may range from relatively dilute solutions of about 0.0001 weight percent which are suitable for continuous application, up to the solubility or gelling limits of the polymer. In general, when the polymer solutions are to be continuously applied to the whitewater system, it is preferred that the anionic soluble charge be greater than or equal to the magnitude of the cationic soluble charge of the whitewater.

Mixtures of anionic polymers and anionic surfactants can generally range between 50:1 to 1:50 on a weight basis.

The anionic polymers or anionic surfactants may be added to the aqueous pulp suspension or whitewater system at any convenient location in the paper making machine, provided of course, that they are added to the aqueous pulp suspension or whitewater system prior to its contact with the paper machine equipment surfaces which are prone to its deposits. That is, the neutral or cationic soluble charge of the pulp suspension must be made anionic prior to contact with those paper machine surfaces which are prone to pitch deposits and subsequently treated with a cationic polymer or "surfactant.

The exact dosage range of anionic polymer or anionic surfactant to be added to a neutral or cationic soluble charge pulp suspension is not, per se, critical to the invention, provided however, that it is added in an amount effective to change and maintain the soluble charge of the aqueous pulp suspension from a neutral or cationic soluble charge to anionic soluble charge of at least $-15\mu eq/l$, preferably increased to greater than $-20\ \mu eq/l$ and most preferably greater than $-30\mu eq/l$. The appropriate dosage for a particular system can readily be determined by one of ordinary skill in the art by conventional means.

A convenient method for determining an appropriate dosage amount is to collect a representative sample of the aqueous pulp suspension having a neutral or cationic soluble charge. The intended anionic polymer or anionic surfactant treatment is then added to the sample at various pounds of treatment per ton of pulp suspension. The sample is then filtered to remove the fibers from the pulp suspension, and titrated with a cationic polymer or cationic surfactant of known charge density to the isoelectric or point of zero charge endpoint. The amount of anionic polymer or anionic surfactant required to treat the pulp suspension should provide the filtrate with an anionic charge between $-35\ \mu eq/l$ to $-1000\ \mu eq/l$.

A wide variety of different water-soluble or water dispersible cationic polymers or cationic surfactants can be applied to the equipment surfaces in accordance with the present invention. These cationic materials will generally have a molecular weight from 1000 to 500,000, preferably a molecular weight from 1000 to 100,000, and most preferably from 20,000 to 50,000. The charge density (determined by e.g., streaming current potential or colloidal charge titration) of suitable cationic polymers or surfactants is 0.1 to 10, especially 2 to 8, meq/g.

Preferred cationic polymers for use in accordance with the method of this invention include, polyethylene-imines, especially low molecular weight polyethylene-imines, for example of molecular weight up to 5,000 and especially up to 2,000, including tetraethylene pentamine and triethylene tetramine, as well as various other polymeric materials containing amino groups such as those described in U.S. Pat. No. 3,250,664, 3,642,572, 3,893,885 and 4,250,299 but it is generally preferred to use protonated or quaternary ammonium polymers. These quaternary ammonium polymers are preferably derived from ethylenically unsaturated monomers containing a quaternary ammonium group or are obtained by reaction between an epihalohydrin and one or more amines such as those obtained by reaction between a polyalkylene polyamine and epichlorohydrin, or by reaction between epichlorohydrin dimethylamine and either ethylene diamine or polyalkylene polyamine. Other cationic polymers which can be used include dicyandiamide-formaldehyde condensates. Polymers of this type are disclosed in U.S. Pat. No. 3,582,461. Either formic acid or ammonium salts, and most preferably both formic acid and ammonium chloride, may also be included as polymerization reactants. One dicyandiamideformaldehyde type polymer found effective for film formation contains as its active ingredient about 50 weight percent of polymer believed to have a molecular weight between about 20,000 to 50,000.

Typical cationic polymers which can be used in the present invention and which are derived from an ethylenically unsaturated monomer include homo- and copolymers of vinyl compounds such as vinyl pyridine and vinyl imidazole which may be quaternized with, say, a $C_1$ or $C_{18}$ alkyl halide, a benzyl halide, especially a chloride, or dimethyl or diethyl sulphate, or vinyl benzyl chloride which may be quaternized with, say, a tertiary amine of formula $NR_1R_2R_3$ in which $R_1$ $R_2$ and $R_3$ are independently lower alkyl, typically of 1 to 4 carbon atoms, such that one of $R_1$ $R_2$ and $R_3$ can be $C_1$ to $C_{18}$ alkyl; allyl compounds such as diallyldimethyl ammonium chloride; or acrylic derivatives such as a dialkyl aminomethyl(meth)acrylamide which may be quaternized with, say, a $C_1$ to $C_{18}$ alkyl halide, a benzyl halide or dimethyl or diethyl sulphate, a methacrylamido propyl tri($C_1$ to $C_4$ alkyl, especially methyl) ammonium salt, or a(meth)acryloyloxyethyl tri($C_1$ to $C_4$ alkyl, especially methyl) ammonium salt, said salt being a halide, especially a chloride, methosulphate, ethosulphate or 1/n of an n-valent anion. These monomers may be copolymerized with a(meth)acrylic derivative such as acrylamide, an acrylate or methacrylate $C_1$–$C_{18}$ alkyl ester or acrylonitrile. Typically such polymers contain 10–100 mol % of recurring units of the formula:

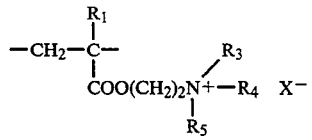

and 0–90 mol % of recurring units of the formula:

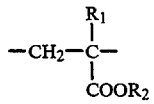

in which $R_1$ represents hydrogen or a lower alkyl radical, typically of 1–4 carbon atoms, $R_2$ represents a long chain alkyl group, typically of 8 to 18 carbon atoms, $R_3$, $R_4$ and $R_5$ independently represent hydrogen or a lower alkyl group while X represents an anion, typically a halide ion, a methosulfate ion, an ethosulfate ion or 1/n of a n valent anion.

Other quaternary ammonium polymers derived from an unsaturated monomer include the homo-polymer of dialyldimethylammonium chloride which possesses recurring units of the formula:

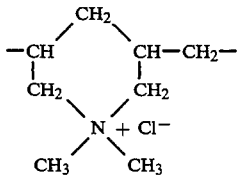

as well as copolymers thereof with an acrylic acid derivative such as acrylamide.

Other polymers which can be used and which are derived from unsaturated monomers include those having the formula:

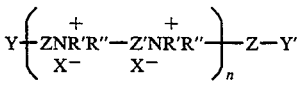

where Z and Z' which may be the same or different is $—CH_2CH{=}CHCH_2—$ or $—CH_2—CHOHCH_2—$, Y and Y', which may be the same or different, are either X or —NH'R", X is a halogen of atomic weight greater than 30, n is an integer of from 2 to 20, and R' and R" (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and oxygen atom represent the N-morpholino group, which are described in U.S. Pat. No. 4,397,743. A particularly preferred such polymer is poly(dimethylbutenyl) ammonium chloride bis-(triethanol ammonium chloride).

Another class of polymer which can be used and which derived from ethylenically unsaturated monomers includes polybutadienes which have been reacted with a lower alkyl amine and some of the resulting dialkyl amino groups are quaternized. In general, therefore, the polymer will possess recurring units of the formula:

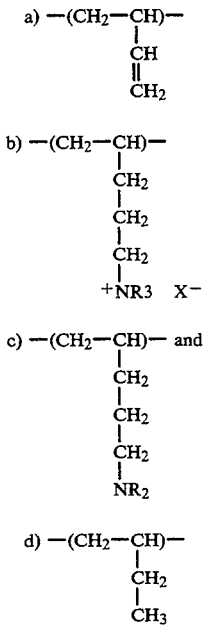

in the molar proportions a:b:c:d, respectively, where R represents a lower alkyl radical, typically a methyl or ethyl radical. It should be understood that the lower alkyl radicals need not all be the same. Typical quaternizing agents include methyl chloride, dimethyl sulfate and diethyl sulfate. Varying ratios of a:b:c:d may be used with the amine amounts (b+c) being generally from 10–90% with (a+c) being from 90%–10%. These polymers can be obtained by reacting polybutadiene with carbon monoxide and hydrogen in the presence of an appropriate lower alkyl amine.

Of the quaternary ammonium polymers which are derived from epichlorohydrin and various amines, particular reference should be made to the polymers described in British Specification Nos. 2085433 and 1486396. A typical amine which can be employed is N,N,N',N'-tetra-methylethylenediamine as well as ethylenediamine used together with dimethylamine and triethanolamine. Particularly preferred polymers of this type for use in the present invention are those having the formula:

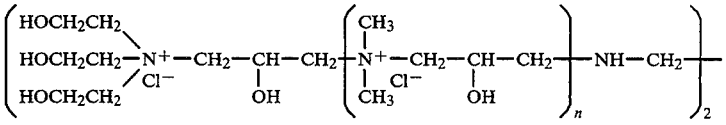

where n is from 0–500, although, of course, other amines can be employed.

Other polymers which can be used include cationic lignin, starch and tannin derivatives, such as those obtained by a Mannich type reaction of tannin (a condensed polyphenolic body) with formaldehyde and an amine, formed as a salt e.g. acetate, formate, hydrochloride or quaternized, as well as polyamine polymers which have been crosslinked such as polyamideamine/-polyethylene polyamine copolymers crosslinked with, say, epichlorohydrin.

The preferred cationic polymers of this invention also include those made by reacting dimethylamine, diethylamine, or methylethylamine, preferably either dimethylamine or diethylamine with an epihalohydrin, preferably epichlorohydrin, such as those disclosed in U.S. Pat. No. 3,738,945 and CA-A-1,096,070. Such polymers reportedly contain as their active ingredients about 50 weight percent of polymers having molecular weights of about 10,000 to 250,000.

In addition polyquaternary polymers derived from (a) an epihalohydrin or a diepoxide or a precursor thereof especially epichloro- or epibromo-hydrin, (b) an alkylamine having an epihalohydrin functionality of 2, especially a dialkylamine having 1 to 3 carbon atoms such a dimethylamine and (c) ammonia or an amine which has an epihalohydrin functionality greater than 2 and which does not possess any carbonyl groups, especially a primary amine or a primary alkylene polyamine such as diethylaminobutylamine, dimethylamino propylamine and ethylene diamine. Such polymers can also be derived from a tertiary amine or a hydroxyalkylamine. Further details regarding such polymers are to be found in, for example, GB-A-2085433, U.S. Pat. No. 3,855,299 and U.S. Pat. No. Reissue 28,808.

The dosage amount can vary widely depending upon the nature of the system being treated, and in general is from 100 ppm to 10,000 ppm, preferably from 500 ppm to 1000 ppm. The exact dosage amount for a particular system can be readily determined by one of ordinary skill in the art by conventional methods.

Suitable cationic surfactants for use in this invention include any cationic surfactant which is water soluble and which is capable of maintaining a cationic charge. Particularly preferred cationic surfactants suitable for use in this invention include water soluble surfactants having molecular weights between about 200 and 800 and having the general formula:

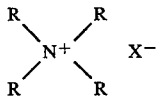

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms and preferably an n-alkyl group having between about 12 and 16 carbon atoms; and wherein $X^-$ is an anion, typically a halide ion (e.g., chloride). Mixtures of these compounds can also be used as the surfactant of this invention.

Preferably two of the R groups of the cationic surfactants of the formula are selected from the group consisting of methyl and ethyl, and are most preferably methyl; and preferably one R group is selected from the aralkyl groups

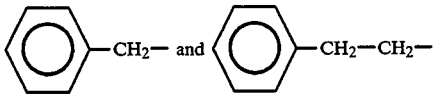

and is most preferably benzyl. Particularly useful surfactants thus include alkyl dimethyl benzyl ammonium chlorides having alkyl groups with between about 12 and 16 carbon atoms. One commercially available product of this type includes a mixture of alkyl dimethyl benzyl ammonium chlorides wherein about 50% of the surfactant has a $C_{14}H_{29}$ n-alkyl group, about 40% of the surfactant has a $C_{12}H_{25}$ n-alkyl group, and about 10% of the surfactant has a $C_{16}H_{33}$ n-alkyl group. This product is known for its microbicidal effectiveness.

The surfactants considered suitable for use in this invention also include the group of pseudo-cationic materials having a molecular weight between about 1,000 and 26,000 and having the general formula $NR_1R_2R_3$, wherein $R_1$ and $R_2$ are polyethers such as polyethylene oxide, polypropylene oxide or a combined chain of ethylene oxide and propylene oxide, and wherein $R_3$ is selected from the group consisting of polyethers, alkyl groups, or hydrogen. Examples of this type of surfactant are disclosed in U.S. Pat. No. 2,979,528.

The method of this invention has been found to provide a significant reduction in pitch deposits on paper machine equipment surfaces in paper making processes which use aqueous pulp suspensions having a neutral or cationic soluble charge. The application of cationic polymers and/or cationic surfactants alone, to paper machine equipment surfaces to reduce pitch deposits in these paper making processes has been generally ineffective. In addition, the application of anionic dispersants to these neutral or cationic pulp suspensions for the purpose of dispersing pitch particles therein, would not be expected to change the soluble charge of the pulp suspension from cationic to anionic since pitch dispersants are added in low dosage amounts and would therefore not be added in an amount effective to change and maintain an anionic soluble charge in the pulp suspension.

The following examples are provided to illustrate the present invention in accordance with the principles of this invention, but are not to be construed as limiting the invention in any way except as indicated in the appended claims. All parts and percentages are by weight unless otherwise indicated.

EXAMPLE 1

This example demonstrates the effectiveness of the present invention for controlling pitch deposits on paper making machines used to manufacture tissue paper. The tissue machine in this example (Tissue Machine D) used a low grade furnish which is commonly used to prepare consumer grade toweling. The furnish contained a relatively high dosage amount of a cationic wet strength resin, i.e., an amount sufficient to maintain a cationic soluble charge of +16μeq/l. Since the whitewater in this machine was recycled, the cationic soluble charge continually increased due to the increasing concentrations of cationic components in the aqueous system ("cycling up"). Samples of the whitewater were taken from this machine and titrated with an anionic polymer to determine the titer of whitewater. The whitewater system was then treated with an anionic polymer in the indicated feed rate in the following tables.

The results in Table 1, from 10:45 until 4:00 on Day One, illustrate the approximate soluble charge of the whitewater during the time of this trial.

TABLE 1

Whitewater Samples - Tissue Machine D
Spray Application of Both Anionic
& Cationic Polymer on Forming Fabric

| Time | Chemical Feed Rate | Titrant | Charge |
|---|---|---|---|
| Day 1 | | | |
| | Na-NSF Copolymer* | | |
| 9:00 | 0 ml/min | Na-NSF | +16 μeq/l |
| 9:00 | DMA-EPI 0 ml/min** | Na-NSF | +12 μeq/l |
| 9:00 | | PES | +27 μeq/l |
| 9:00 | | PES | +20 μeq/l |
| | Na-NSF Copolymer | | |
| 10:45 | 10 ml/min | Na-NSF | ≈+4.5 μeq/l |
| 11:10 | DMA-EPI 50 ml/min | Na-NSF | ≈+4.5 μeq/l |
| 12:50 | | Na-NSF | ≈+4.5 μeq/l |
| 2:15 | | none | 0 |
| | Na-NSF Copolymer | | |
| 3:00 | 20 ml/min | DMA-EPI | ≈−2.5 μeq/l |
| 4:00 | DMA-EPI 50 ml/min | DMA-EPI | ≈−2.5 μeq/l |
| Day 2 | | | |
| 12:00 | Na-NSF Copolymer | | |
| 12:00 | 60 ml/min | DMA-EPI | −11 μeq/l |
| 2:50 | DMA-EPI 50 ml/min | DMA-EPI | −25 μeq/l |
| 3:00 | Na-NSF Copolymer | | |
| 4:30 | 175 ml/min | DMA-EPI | −28 μeq/l |
| 5:20 | DMA-EPI 50 ml/min | DMA-EPI | −25 μeq/l |
| 9:30 | | DMA-EPI | −14 μeq/l |
| Day 3 | | | |
| | Na-NSF Copolymer | | |
| 8:00 | 159 ml/min | DMA-EPI | −15 μeq/l |
| 10:00 | DMA-EPI 50 ml/min | DMA-EPI | −6 μeq/l |
| 11:00 | | DMA-EPI | −8 μeq/l |
| 1:00 | | DMA-EPI | −5 μeq/l |
| | Na-NSF Copolymer | | |
| 2:30 | 188 ml/min | DMA-EPI | −21 μeq/l |
| 3:30 | DMA-EPI 50 ml/min | DMA-EPI | −32 μeq/l |
| 4:30 | | DMA-EPI | −38 μeq/l |

*Na-NSF sodium naphthalenesulfonate formaldehyde copolymer
**DMA-EPI dimethylamine epichlorohydrin solution All of the anionic polymer or surfactant solutions used to treat the various whitewater samples were standardized by titrating with either 0.001N polydialkyldimethyl ammonium chloride (DADMAC) or 0.001N polyethenesulphonate (PES) solution to the point of zero charge. The charge of sodium naphthalenesulfonate formaldehyde copolymer (Na-NSF) and dimethylamine epichlorohydrin (DMA-EPI) solution were known for each titrant.

Initially, two different anionic solutions were used to determine the soluble charge of the whitewater samples. The first was a 0.1% solution of Na-NSF and the second was a 0.01% solution of PES. Both results showed the whitewater was cationic in soluble charge. However, as noted in Table 1, there were differences in the calculated cationic soluble charges for the same whitewater sample taken at 9:00, when titrated with either Na-NSF or PES. The whitewater sample required less Na-NSF copolymer to reach the point of zero charge than PES. It is believed that the Na-NSF copolymer may be more efficiently adsorbed than the PES and is thus more efficient in reducing the cationic soluble charge of the whitewater. This would account for the differences in calculated charge of the same sample.

Qualitative tests were used to rank the quality/holes in the sheet wherein the first number is the sheet appearance and the second number is the edge of the sheet. The edge selected for the qualitative test is the poorest edge. The number rating is 1 through 8 wherein 1 is the best. This tissue machine normally produced a poor quality sheet and stickies were never controlled on the machine. By reducing the amount of pitch adhering to the forming fabric, less holes were produced in the sheet. Thus, an improvement in sheet quality is indicative of a substantial reduction in pitch deposition on the paper machine surfaces. Table 2 provides the results of the trial.

TABLE 2

| Sheet Quality - D Tissue Machine | | | |
|---|---|---|---|
| Day 1 | | Day 2 | |
| Time | Number | Time | Number |
| 6:15 | 4/4 | 6:40 | 3/3 |
| 7:55 | 3/2 | 8:12 | 3/6 |
| 9:35 | 4/4 | 9:20 | 3/4 |
| 11:00 | 4/6 | 10:35 | 3/3 |
| 12:10 | 4/6 | 12:35 | 3/2 |
| 1:30 | 4/6 | 2:45 | 3/3 |
| 2:40 | 4/7 | 4:15 | 2/2 |
| 5:40 | 2/3 | 4:32 | 2/3 |
| 5:30 | 3/4 | 6:50 | 2/3 |
| 7:00 | 3/3 | 8:00 | 2/4 |
| 8:10 | 3/3 | 9:20 | 2/4 |
| 9:00 | 3/3 | 11:30 | 2/3 |
| 10:40 | 4/3 | 1:10 | 3/3 |
| 11:50 | 4/3 | 2:30 | 3/2 |

TABLE 2-continued

| Sheet Quality - D Tissue Machine | | | |
|---|---|---|---|
| Day 1 | | Day 2 | |
| Time | Number | Time | Number |
| 1:15 | 3/3 | 3:55 | 3/3 |
| 3:30 | 3/2 | 5:14 | 2/3 |
| 4:50 | 2/3 | | |
| 5:40 | 4/3 | | |
| Ave | 3.5/3.8 | Ave | 2.6/3.1 |

As the soluble charge became more anionic (Table 1) the sheet quality improved (Table 2). There is, of course, a limit in the particular grade of tissue paper produced due to the nature of the low grade furnish, and any further increases in anionic soluble charge would not have resulted in further improvements in the sheet quality. On day 1, Na-NSF copolymer was spray applied to the inside of the forming fabric and DMA-EPI was spray applied to the outside of the forming fabric.

On Day 2 at 12:00 samples were collected and the chemical feed was changed as follows; the DMA-EPI was applied by spraying the inside of the forming fabric and the Na-NSF copolymer was applied by spraying the outside of the forming fabric. The resulting whitewater increased in anionic soluble charge from $-11\mu eq/l$ to $-25\ \mu eq/l$. This change in the chemical feed allowed more anionic Na-NSF to treat the whitewater. A pitch resistant polymeric coating formed on the forming fabric after this change was made.

Several times the chemical feed was changed from the inside to the outside shower position. The anionic soluble charge of the whitewater increased each time the Na-NSF copolymer was sprayed on the outside of the forming fabric. This is apparent from the results in Table 1.

Table 3 illustrates the soluble charge of the overspray at various shower water positions.

TABLE 3

| Shower Water Charge - D Tissue Machine<br>Chemical Feed Rate<br>Na-NSF Copolymer 60 ml/min<br>DMA-EPI 50 ml/min | | | | |
|---|---|---|---|---|
| Location | Concentration of Titrant | ml | Titrant | Charge |
| Na-NSF copolymer sprayed inside the wire, DMA-EPI sprayed outside the wire. | | | | |
| Day 1 Time: 12:00 | | | | |
| Before Anionic Shower | 0.15 μeq/ml | 0.82 | DMA-EPI | −13 μeq/ml |
| After Anionic Shower | 7.5 μeq/ml | 1.3 | DMA-EPI | −1007 μeq/ml |
| After Cationic Shower | 2.9 μeq/ml | 4.49 | Na-NSF | +1302 μeq/ml |
| Whitewater | 0.15 μeq/ml | 0.71 | DMA-EPI | −11 μeq/ml |
| DMA-EPI sprayed inside the wire, Na-NSF copolymer sprayed outside the wire. | | | | |
| Day 2 Time: 2:50 | | | | |
| Before Cationic Shower | 0.15 μeq/ml | 0.87 | DMA-EPI | −14 μeq/ml |
| After Cationic Shower | 2.9 μeq/ml | 0.45 | Na-NSF | +130 μeq/ml |
| After Anionic Shower | 0.15 μeq/ml | 0.82 | DMA-EPI | −13 μeq/ml |
| Whitewater | 0.15 μeq/ml | 1.61 | DMA-EPI | −26 μeq/ml |

The soluble charge of the whitewater after sheet release remained the same at −13 to −14 μeq/l. The soluble charge of the whitewater before sheet release changed significantly from −11 μeq/l to −26 μeq/l. This was believed to be due to the Na-NSF shower treatment increasing the anionic charge of the whitewater by deflecting off the forming fabric and reacting with the whitewater.

Spraying an anionic and cationic polymer at an equal charge basis did not form a pitch resistant polymeric film on the forming fabric. Only when the flow rate of the anionic polymer to the whitewater was substantially increased did a pitch resistant polymeric film develop. This light brown, pitch resistant polymeric film appeared on the forming fabric when the soluble charge of the whitewater changed from −14 to −27 μeq/l. The film was darker and more evident when the soluble charge was −32 μeq/l.

EXAMPLE 2

A second trial using the same chemical treatment was evaluated on tissue machine D. However in this experiment, the anionic material was fed directly into the wire pit to treat the whitewater. The dosage was increased to 240 ml/min of Na-NSF to quickly change the soluble charge of the whitewater system from cationic to anionic. Table 4 is a summary of the soluble charge of the whitewater from this trial.

TABLE 4

| | D Tissue Machine Whitewater | | |
|---|---|---|---|
| Time | Chemical Feed Rate | Titrant | Charge |
| Day 1 | | | |
| | Na-NSF Copolymer | | |
| 8:00 | 0 ml/min | | |
| | DMA/EPI | NA-NSF | +5.0 μeq/l |
| 9:00 | Na-NSF Copolymer | NA-NSF | +5.8 μeq/l |
| 11:00 | 260 ml/min | NA-NSF | +9.6 μeq/l |
| 1:15 | DMA-EPI 0 ml/min | DMA-EPI | −10.3 μeq/l |
| 2:30 | | DMA-EPI | −6.2 μeq/l |
| 4:00 | | DMA-EPI | −9.5 μeq/l |
| 5:00 | | DMA-EPI | −38.2 μeq/l |
| 7:00 | | DMA-EPI | −24.7 μeq/l |
| 8:00 | | DMA-EPI | −26.3 μeq/l |
| 9:30 | | DMA-EPI | −7.6 μeq/l |
| | Na-NSF Copolymer | | |
| Day 2 | Na-NSF Copolymer | | |
| 8:00 | 260 ml/min | DMA-EPI | −15.3 μeq/l |
| | DMA-EPI 50 ml/min | | |
| 8:30 | Na-NSF Copolymer | | |
| 9:30 | 0 ml/min | DMA-EPI | −7.6 μeq/l |
| 11:00 | | DMA-EPI | −9.7 μeq/l |
| 1:00 | DMA-EPI 0 ml/min | DMA-EPI | −9.3 μeq/l |

Sheet quality numbers were also determined during the trial. These results are provided in Table 5.

TABLE 5

| | Sheet Quality - D Tissue Machine | |
|---|---|---|
| | Time | Sheet Appearance |
| Day 1 | 6:35 | 2/3 |
| | 7:45 | 3/7 |
| | 9:30 | 5/8 |
| | 9:30 | 6/8 |
| | 11:40 | 3/7 |
| | 1:30 | 4/7 |
| | 3:00 | 3/6 |
| | 4:32 | 2/3 |
| | 6:48 | 2/4 |
| | 8:05 | 2/2 |
| | 9:10 | 3/3 |
| | 10:45 | 3/3 |
| | 12:05 | 4/3 |
| | 1:15 | 4/3 |
| | 2:35 | 4/2 |
| | 4:00 | 4/2 |
| | 5:20 | 4/2 |

During this trial, the whitewater possessed a highly anionic soluble charge between 4:00 to 8:00 p.m. on the first day of the trial (Table 4). Highest sheet quality (Table 5) was also obtained during the period between 4:32 to 9:10 p.m. Reduced pin holes in the sheet was the reason for the improvement. A reduction in pin holes is indication that pitch deposition is in control.

EXAMPLE 3

During the third trial of Na-NSF copolymer, the whitewater soluble charge was not changed to anionic. The previous trial showed that when the whitewater had an artionic soluble charge of −24 μeq/l, a light polymeric coating developed on the forming fabric.

In this trial, the paper grade changed from toweling (which was used in the previous trials) to an industrial toweling grade. A cationic polyamide and polyacrylamide resin was fed into the aqueous pulp suspension at the mix well at a dosage rate of 1500 ml/min and 5600 ml/min respectively. Later in the trial, (11:15 on day 2) the feed rate of the polyacrylamide resin was lowered to 4000 ml/min.

A polymeric coating did not develop on the forming fabric during the three days of monitoring. However, when the cationic additives were reduced during a grade change later in the week, a light coating developed on the forming fabric.

By comparing the soluble charge of the headbox, (see Table 6), with the soluble charge of the whitewater (see Table 7), it is apparent that the soluble charge of the whitewater was only anionic on the third day of the trial between 7:30 and 10:00. However, the soluble charge of the headbox was anionic on the first and second day of the trial. Whitewater with an anionic soluble charge greater than −24μeq/l is required to form a polymeric coating on the forming fabric to protect against stickies deposition.

The feed point of the Na-NSF copolymer was changed after each trial. The first trial, Na-NSF copolymer was sprayed onto both the inside and outside of the forming fabric with a shower bar. By spraying both an anionic and cationic polymer onto forming fabric a pitch resistant polymeric film was anticipated to develop. However, this coating did not develop. Only by over feeding the anionic polymer to the whitewater to obtain an anionic soluble charge did the pitch resistant polymeric film form.

In the second trial, the Na-NSF copolymer was fed to the backside of the wire pit where mixing of the Na-NSF copolymer occurred naturally with the whitewater. A light brown pitch resistant polymeric film developed and stickies were under control when the whitewater again obtained a certain anionic charge.

The third trial, Na-NSF copolymer was fed to the fan pump. The cationic polymers fed to the tissue machine were substantially of greater charge in this trial than in the earlier trials and the dosage amount of the anionic dispersant was insufficient to change the soluble charge and accordingly a polymeric pitch resistant film did not develop on the forming fabric.

In view of the foregoing, it is apparent that the location and method used to apply the Na-NSF copolymer is not important in controlling pitch deposits. The important criteria is to change the cationic or neutral soluble charge of the whitewater to an anionic soluble charge greater than −20 μeq/l.

TABLE 6

| Time | Chemical Feed Rate | ml Titrant | Titrant | Charge |
|---|---|---|---|---|
| | Tissue Machine D - Whitewater Sample Fan Pump Addition | | | |
| Day 1 | | | | |
| 9:45 a.m. | Na-NSF Copolymer | 4.5 | Na-NSF | +627 μeq/l |
| 10:45 | 0 ml/min | 8.0 | Na-NSF | +1000 μeq/l |
| 11:45 | DMA-EPI 0 ml/min | 11.15 | Na-NSF | +1393 μeq/l |
| 1:00 p.m. | | 8.0 | Na-NSF | +1000 μeq/l |
| 1:45 | | 6.3 | Na-NSF | +788 μeq/l |
| 3:15 | Na-NSF 94 ml/min | | | |
| 3:30 | DMA-EPI 50 ml/min | 4.6 | Na-NSF | +575 μeq/l |
| 4:45 | | 5.9 | Na-NSF | +737 μeq/l |
| 5:45 | Na-NSF 170 ml/min | | | |
| 6:30 | DMA-EPI 50 ml/min | 4.28 | Na-NSF | +642 μeq/l |
| 9:15 | | 3.60 | Na-NSF | +540 μeq/l |
| 10:15 | Na-NSF 0 ml/min | 4.00 | Na-NSF | +600 μeq/l |
| 10:15 | DMA-EPI 50 ml/min | | | |
| Day 2 | | | | |
| 8:00 a.m. | | 3.75 | Na-NSF | +563 μeq/l |
| 8:15 | Na-NSF 100 ml/min | | | |
| 9:15 | DMA-EPI 50 ml/min | 1.13 | Na-NSF | +170 μeq/l |
| 9:15 | Na-NSF 160 ml/min | | | |
| 10:15 | DMA-EPI 50 ml/min | 0.90 | Na-NSF | +135 μeq/l |
| 11:15 | | 0.65 | Na-NSF | +81 μeq/l |
| 11:30 | Na-NSF 225 ml/min | | | |
| 12:30 p.m. | DMA-EPI 50 ml/min | 0.31 | Na-NSF | +39 μeq/l |
| 1:30 | | 0.30 | Na-NSF | +31 μeq/l |
| 2:30 | | 0.34 | Na-NSF | +51 μeq/l |
| 3:30 | | 0.27 | Na-NSF | +41 μeq/l |
| 4:00 | Changed chemical feed from fan pump to backside of saveall. Maintained chemical feed rates. | | | |
| 4:15 p.m. | Na-NSF 225 ml/min | 0.28 | Na-NSF | +42 μeq/l |
| | DMA-EPI 50 ml/min | 0.28 | Na-NSF | +42 μeq/l |
| 4:45 | Sheet wrapped felt. Shut down to clean felt. | | | |
| 5:15 | | 2.95 | Na-NSF | +7.4 μeq/l |
| 5:15 | Sheet was off machine, but tested whitewater. | | | |
| 6:00 | | 0.6 | Na-NSF | +90 μeq/l |
| 7:30 | | 0.48 | Na-NSF | +72 μeq/l |
| 8:30 | | 0.34 | Na-NSF | +51 μeq/l |
| 9:00 | Changed chemical feed from backside of saveall to fan pump. | | | |
| | Na-NSF 75 ml/min | | | |
| | DMA-EPI 0 ml/min | | | |
| Day 3 | | | | |
| 7:30 a.m. | Na-NSF 175 ml/min | 1.25 | DMA-EPI | −18 μeq/l |
| 8:00 | DMA-EPI 50 ml/min | | | |
| 9:00 | | | none | 0 μeq/l |
| 9:15 | Na-NSF 225 ml/min | | | |
| 10:00 | DMA-EPI 50 ml/min | 0.15 | DMA-EPI | −2.2 μeq/l |
| 12:30 p.m. | | 0.13 | Na-NSF | +20.9 μeq/l |
| 1:30 | | 0.10 | Na-NSF | +13 μeq/l |

TABLE 7

| Time | Chemical Feed Rate | ml Titrant | Titrant | Charge |
|---|---|---|---|---|
| | Tissue Machine D - Headbox Sample Fan Pump Addition | | | |
| Day 1 | | | | |
| 9:45 a.m. | Na-NSF Copolymer | 4.5 | Na-NSF | +628 μeq/l |
| 10:45 | 0 ml/min | 8.0 | Na-NSF | +1000 μeq/l |
| 11:45 | DMA-EPI 0 ml/min | 12.0 | Na-NSF | +1250 μeq/l |
| 1:00 p.m. | | 7.5 | Na-NSF | +931 μeq/l |
| 1:45 | | 6.0 | Na-NSF | +750 μeq/l |
| 3:15 | | | | |
| 3:30 | Na-NSF 94 ml/min | 4.0 | Na-NSF | +600 μeq/l |
| 4:45 | DMA-EPI 50 ml/min | 2.3 | Na-NSF | +342 μeq/l |
| 5:45 | | | | |
| 6:30 | Na-NSF 170 ml/min | 2.9 | Na-NSF | +432 μeq/l |
| 9:15 | DMA-EPI 0 ml/min | 3.6 | Na-NSF | +540 μeq/l |
| 10:15 | | 2.7 | Na-NSF | +400 μeq/l |
| 10:15 | Na-NSF 0 ml/min | | | |
| | DMA-EPI 0 ml/min | | | |
| Day 2 | | | | |
| 8:00 a.m. | | 3.8 | Na-NSF | +473 μeq/l |
| 8:15 | Na-NSF 100 ml/min | | | |
| 9:15 | DMA-EPI 50 ml/min | 0.60 | Na-NSF | +83 μeq/l |
| 9:15 | | | | |
| 10:15 | | 2.75 | | −6.9 μeq/l |
| 11:15 | | 2.38 | | −5.9 μeq/l |
| 11:30 | Na-NSF 225 ml/min | | | |

TABLE 7-continued

| Tissue Machine D - Headbox Sample Fan Pump Addition | | | | |
|---|---|---|---|---|
| Time | Chemical Feed Rate | ml Titrant | Titrant | Charge |
| 12:30 p.m. | DMA-EPI 50 ml/min | 2.59 | DMA-EPI | −6.5 μeq/l |
| 1:30 | | 4.57 | DMA-EPI | −11.5 μeq/l |
| 2:30 | | 4.00 | DMA-EPI | −10.0 μeq/l |
| 3:30 | | 2.90 | DMA-EPI | −7.25 μeq/l |
| 4:00 | Na-NSF 225 ml/min DMA-EPI 50 ml/min Added to Wire Pit | | | |
| 4:15 p.m. | | | none | 0 μeq/l |
| 4:45 | Sheet wrapped the felt. Shut down to clean felt. | | | |
| 5:15 | | 0.05 | DMA-EPI | −6.26 μeq/l |
| 6:00 | | none | none | 0 μeq/l |
| 7:30 | | 0.40 | DMA-EPI | −1 μeq/l |
| 8:30 | | none | none | 0 μeq/l |
| 9:00 | Na-NSF 75 ml/min DMA-EPI 0 ml/min | | | |
| Day 3 | | | | |
| 7:30 a.m. | | 0.25 | DMA-EPI | −31.2 μeq/l |
| 8:00 | Na-NSF 175 ml/min | | | |
| 9:00 | DMA-EPI 50 ml/min | 0.28 | DMA-EPI | −38.7 μeq/l |
| 9:15 | Na-NSF 225 ml/min | | | |
| 10:00 | DMA-EPI 50 ml/min | 0.21 | DMA-EPI | −26.2 μeq/l |
| 12:30 p.m. | | 0.30 | DMA-EPI | −37.5 μeq/l |
| 1:30 | | 0.32 | DMA-EPI | −42.5 μeq/l |

TABLE 8

| D Tissue Machine - Sheet Appearance Industrial Towels | | | | | | | |
|---|---|---|---|---|---|---|---|
| A | | B | | C | | Day 1 | |
| Time | Rating | Time | Rating | Time | Rating | Time | Rating |
| 6:55 | C | 6:35 | C | 8:35 | D | 6:45 | C |
| 8:25 | C | 8:15 | C | 10:00 | C | 8:15 | C |
| 10:00 | C | 9:40 | C | 2:55 | B | 9:00 | C |
| 12:00 | C | 12:20 | C | 4:20 | C | 11:45 | C |
| 3:20 | C | 2:40 | B | 6:15 | C | 12:55 | C |
| 4:50 | C | 4:10 | B | 7:45 | C | 3:00 | B |
| 5:55 | C | 5:30 | C | 9:20 | C | 4:20 | C |
| 7:15 | C | 12:40 | C | 10:55 | C | 5:45 | C |
| 8:40 | C | 2:20 | C | 12:20 | C | 7:05 | B |
| 10:45 | C | 5:20 | B | 3:20 | B | 8:40 | C |
| 12:30 | C | | | 4:45 | C | 10:50 | C |
| 2:00 | C | | | | | 12:15 | C |
| 3:30 | C | | | | | 1:40 | C |
| 4:30 | C | | | | | 3:15 | C |
| | | | | | | 4:45 | C |

The data in Table 8 illustrates that the sheet appearance did not improve significantly since the soluble charge of the whitewater was never in the −24 μeq/l range. The data in columns A, B, and C represent performance ratings for the three days prior to Day 1 and is provided for background data on the machine. First pass retention, as provided in Table 9, was monitored on D tissue machine during soluble charge monitoring. The addition of the anionic material did not negatively affect the first pass retention and in fact improved the runnability of the machine as evidenced by a lower standard deviation of first pass retention values.

TABLE 9

| D Tissue Machine - First Pass Retention | | | |
|---|---|---|---|
| Time | Headbox Consistency | Whitewater Consistency | First Pass Retention |
| Day 1 | | - Control - | |
| 9:45 | 0.73% | 0.46% | 37.0% |
| 10:45 | 0.63% | 0.28% | 55.6% |
| 11:45 | 0.58% | 0.32% | 44.8% |
| 1:00 | 0.55% | 0.30% | 45.5% |
| 1:45 | 0.58% | 0.32% | 44.8% |
| Ave | | | 45.5% |
| s | | | 6.6 |
| 3:15 | Na-NSF copolymer added to fan pump 94 ml/min; | | |

TABLE 9-continued

| D Tissue Machine - First Pass Retention | | | |
|---|---|---|---|
| Time | Headbox Consistency | Whitewater Consistency | First Pass Retention |
| | DMA-EPI 50 ml/min applied on the wire. | | |
| 3:45 | 0.67% | 0.39% | 41.8% |
| 4:45 | 0.62% | 0.38% | 38.7% |
| 6:30 | 0.65% | 0.40% | 38.5% |
| 9:15 | 0.61% | 0.35% | 42.6% |
| 10:15 | 0.62% | 0.35% | 43.5% |
| Ave | | | 41.0% |
| s | | | 2.3 |
| 10:15 | Na-NSF copolymer 0 ml/min; DMA-EPI 0 ml/min | | |
| Day 2 | | | |
| 8:00 | 0.66% | 0.40% | 39.4% |
| 8:15 | Na-NSF copolymer added to the fan pump 100 ml/min; DMA-EPI 50 ml/min on the wire | | |
| 9:15 | 0.75% | 0.44% | 41.3% |
| 9:15 | Na-NSF copolymer added to fan pump 160 ml/min; DMA-EPI 50 ml/min applied on the wire | | |
| 10:15 | 0.64% | 0.39% | 39.4% |
| 11:15 | 0.67% | 0.39% | 41.8% |
| 11:30 | Na-NSF copolymer added to fan pump 225 ml/min; DMA-EPI 50 ml/min applied on the wire | | |
| 12:30 | 0.69% | 0.40% | 42.0% |
| 1:30 | 0.67% | 0.37% | 44.8% |
| 2:30 | 0.65% | 0.36% | 44.6% |
| 4:15 | 0.64% | 0.40% | 37.5% |
| Ave | | | 42.3% |
| s | | | 3.4 |

EXAMPLE 4

A Comparison of Soluble Charge on Two Tissue Machines

C and D tissue machines were monitored during the third Na-NSF copolymer trial. The furnish in C tissue machine was identical to that used in D tissue machine except that no cationic additives were used. The whitewater soluble charge of tissue machine C was −70 to −120 μeq/l compared to D tissue machine having a soluble charge of −14 to −35 μeq/l. On day 2, tissue machine C made a small grade change wherein the fibers were treated with a cationic dye to color the tissue. The soluble charge of the whitewater changed to ≈ −2.5 μeq/l due to the addition of the cationic dye to the furnish. When no cationic additives were used in the furnish on C tissue machine, pitch deposits were in control by spraying a cationic polymer on to the forming fabric. However, after the addition of the cationic dye a pitch resistant coating did not form on the equipment surfaces and the quality of the sheet diminished and the quantity of pin holes increased.

TABLE 10

| | C Tissue Machine | |
|---|---|---|
| Time | Whitewater Sample Soluble Charge | Headbox Sample Souble Charge |
| Day 1 | | |
| 9:45 a.m. | −120 μeq/l | −28.8 μeq/l |
| 10:45 | −71 μeq/l | 0 |
| 11:45 | −80 μeq/l | −31 μeq/l |
| 1:00 p.m. | −114 μeq/l | −19 μeq/l |
| 1:45 | −100 μeq/l | −19 μeq/l |
| 3:30 | −46 μeq/l | −5 μeq/l |
| 4:45 | −100 μeq/l | |
| Day 2 | | |
| 10:30 a.m. | ≈−2.5 μeq/l | |

By comparing the data in Table 10 from C tissue machine with the data from D tissue machine (Tables 6 and 7) an understanding was revealed concerning why the cationic DMA-EPI programs did not control pitch.

The soluble charge of C tissue machine was running opposite to D tissue machine. That is, tissue machine D was running with a higher anionic soluble charge in the headbox compared to the whitewater whereas, the soluble charge on tissue machine C was more anionic in the whitewater than the headbox. This was due to the anionic material cycling up on C tissue machine and the cationic wet strength resin cycling up in D tissue machine. Retention with cationic polymeric substances or with anionic colloidal fines is not 100% on a paper machine.

EXAMPLE 5

Evaluating Anionics

Whitewater samples were titrated with various anionic polymers to determine the most efficient products for reducing the soluble charge of the whitewater. All anionic solutions were standardized by titrating with a 0.001N poly-DADMAC solution to the point of zero charge. Table 11 lists the various anionic materials which were evaluated.

TABLE 11

| Tradename | Chemical Name |
|---|---|
| PAA-45 | Polyacrylic Acid |
| Cyanamer P-21 | Copolymers of acrylamide and acrylic acid |
| Lignosol X | Sodium Lignosulphonate |
| Maracell XC-2 | Sodium Lignosulphonate |
| Reed D-90-1 | Lignosulphonate-fatty amine adduct |
| Daxad 15 | Sodium salt of polymerized alkyl naphthalene sulfonic acid |

A test method was developed to determine the relative differences in adsorption of the various chemicals on a whitewater sample. This test method allows one to select a suitable anionic polymer or surfactant to reduce the cationic soluble charge of this particular whitewater system.

TABLE 12

| | Anionics Evaluation | |
|---|---|---|
| Time | Titrant | Charge |
| Day 1 | Whitewater A Tissue | |
| | Polyacrylic Acid | |
| 8:00 a.m. | Cyanamer P-21 | 8.7 μeq/l |
| 8:00 | Cyanamer P-21 | 8.0 μeq/l |
| 8:00 | PAA-45 | 3.4 μeq/l |
| 8:00 | PAA-45 | 3.9 μeq/l |
| | Lignosulphonates | |
| 8:00 | Reed D-90-1 | 10.0 μeq/l |
| 8:00 | Lignosul X | 9.7 μeq/l |
| 8:00 | Marasperse N-22 | 8.1 μeq/l |
| | Napthalene Sulfonic Acid | |
| 8:00 | Daxad 15 | 26.0 μeq/l |
| 8:00 | Daxad 14B | 5.0 μeq/l |
| | Whitewater D Tissue Machine | |
| | Polyacrylic Acid | |
| 9:00 a.m. | Cyanamer P-21 | 2.8 μeq/l |
| | Lignosulphonates | |
| 9:00 | Reed D-90-1 | 10.3 μeq/l |
| 9:00 | Marasperse N-22 | 10.3 μeq/l |
| 9:00 | Maracell XC-2 | 6.0 μeq/l |
| | Napthalene Sulfonic Acid | |
| 9:00 | Daxad 14B | 5.8 μeq/l |
| | Whitewater D Tissue Machine | |
| | Polyacrylic Acid | |
| 11:00 a.m. | PAA-45 | 8.7 μeq/l |
| | Lignosulphonates | |
| 11:00 | Lignosol X | 20.0 μeq/l |
| 11:00 | Maracell XC-2 | 8.5 μeq/l |
| | Napthalene Sulfonic Acid | |
| 11:00 | Daxad 15 | 12.5 μeq/l |
| 11:00 | Daxad 14B | 9.6 μeq/l |
| Day 2 | | |
| | Lignosulphonates | |
| 8:00 a.m. | Maracell XC-2 | 9.9 μeq/l |
| | Napthalene Sulfonic Acid | |
| 8:00 | Daxad 14B | 9.1 μeq/l |

While all of the anionic polymers or anionic surfactants were effective for maintaining an anionic soluble charge in the whitewater, the sodium lignosulphonate or napthalene sulfonic acid was preferred for reducing the cationic soluble charge of the whitewater as the polyacrylic acid.

EXAMPLE 6

Press Felt Fabrics

DMA-EPI/Quaternary Ammonium Blend—Soluble Charge Monitoring

Previously the DMA-EPI/quaternary ammonium blend of cationic polymer/cationic surfactant was tried on D tissue machine pickup felt to control stickies. This trial failed as did the trial using the DMA-EPI cationic polymer alone when applied to the forming fabric to control stickies.

During the Na-NSF copolymer trial, water samples were collected from the suction press. Only the wet tissue sheet and the pickup felt pass through the nip of the suction press where water is removed to increase the solids content on the sheet prior to drying.

When the tissue was formed the soluble charge of the whitewater was anionic (see Table 4). However, after the sheet was transferred to the pickup felt, the additional water removed from the tissue at the suction press had a cationic soluble charge (see Table 13). It is believed that excess cationic polymers entered the whitewater system from the pickup felts.

Excess whitewater from the wire pit is clarified and recycled for pickup felt shower water. As a result, any residual cationic wet strength resin or other cationic material in the whitewater will cycle up. This cationic charged shower water is then applied to the felt for cleaning. Thus, the pickup felt contains a high concentration of soluble cationic-polymers obtained from the discharge water of the suction press.

Since the pickup felt contained soluble cationic polymers, then the discharge from the suction press was neutral or cationic in soluble charge. Thus, even though the whitewater in the wire pit was anionic (Table 4), there was not a cationic soluble charge in the suction press discharge after the tissue was dewatered. Table 4 provides the results from the suction press roll during the Na-NSF copolymer trial.

These results account for Why DMA-EPI/quaternary ammonium blend was not able to control stickies on the felt. Since the felt shower water charge was neutral or cationic in soluble charge (i.e., less than −24 μeq/l), then the DMA-EPI/quaternary ammonium blend was not effective to reduce pitch deposition on the felt.

Anionic additives such as Na-NSF copolymers or lignosulphonates, when added to the suction side of the clarified water pump, would eliminate the cationic soluble charge and would thus provide pitch control on the felt.

TABLE 13

| Tissue Machine D - Suction Press Roll | |
|---|---|
| Time | Charge |
| Day 1 | |
| 2:30 p.m. | +4.2 μeq/l |
| 4:00 | +3.5 μeq/l |
| 5:00 | +7.4 μeq/l |
| 7:00 | +8.1 μeq/l |
| Day 2 | |
| 8:00 a.m. | +12.5 μeq/l |
| 9:30 | +15.9 μeq/l |
| 11:00 | +10.7 μeq/l |

We claim:

1. A method for controlling or inhibiting the deposition of pitch, derived from an aqueous pulp suspension having a neutral or cationic soluble charge, onto paper machine equipment surfaces which contact the aqueous pulp suspension and wherein the pulp suspension is treated on the paper machine to form paper, comprising the steps of:

a) contacting the aqueous pulp suspension with a water soluble anionic polymer or water soluble anionic surfactant in an amount sufficient to change the neutral or cationic soluble charge to an anionic soluble charge of at least −15 μeq/l in the aqueous pulp suspension without negatively affecting the quality of the paper; and b) contacting the paper machine equipment surfaces which contact the aqueous pulp suspension with a water soluble cationic polymer, a water soluble cationic surfactant, or mixture thereof in an amount sufficient to inhibit the deposition of pitch deposits thereon, wherein the cationic polymer or surfactant has a charge density of at least 0.1 meq/g.

2. A method according to claim 1 wherein the anionic polymer has a molecular weight of from 1,000 to 500,000.

3. A method according to claim 1 wherein the anionic polymer is selected from the group consisting of kraft lignins, lignosulfonates, polynaphthalene sulfonates, tannins, sulfonated tannins, and mixtures thereof.

4. A method according to claim 1 wherein the anionic surfactant is selected from the group consisting of alkaryl sulfonates, sulfonated amines, sulfonated amides, carboxylated alcohol ethoxylates, diphenyl sulfonate derivatives, lignins, lignin derivatives, phosphate esters, protein based surfactants, soaps of process resin, sulfates and sulfonates of ethoxylated alkyl phenols, sulfates of ethoxylated alcohols, sulfonated naphthalene and sulfonated alkyl naphthalene.

5. A method according to claim 1 wherein the cationic polymer is a dicyandiamide-formaldehyde condensate polymer optionally including at least one compound selected from the group consisting of formic acid and ammonium salts as polymerization reactants.

6. A method according to claim 5 in which the cationic polymer is derived from a reaction between formaldehyde, dicyandiamide, formic acid, and ammonium chloride.

7. A method according to claim 1 wherein the cationic polymer is obtained by reaction between an epihalohydrin and one or more amines, or is derived from ethylenically unsaturated monomers which contain a quaternary ammonium group.

8. A method according to claim 1 wherein the cationic polymers are protonated or contain quaternary ammonium groups.

9. A method according to claim 1 wherein the cationic polymer is derived by reacting an epihalohydrin with at least one compound selected from the group consisting of diethylamine, dimethylamine, and methylethylamine.

10. A method according to claim 9 wherein the cationic polymer is made by reacting epichlorohydrin with dimethylamine.

11. A method according to claim 9 wherein the cationic polymer is made by reacting epichlorohydrin with diethylamine.

12. A method according to claim 1 wherein the aqueous pulp suspension contains papermill pulp fibers which are at least about 10% by weight derived from recycled material.

13. A method according to claim 12 wherein the papermill pulp fibers are derived about 100% from recycled material.

14. The method of claim 1 wherein the cationic surfactant is selected from those surfactants having a molecular weight between about 200 and 800 and having the general formula:

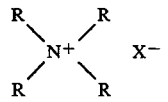

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms, and wherein $X^-$ is an anion.

15. A method according to claim 14 wherein at least one R group of said cationic surfactant is an n-alkyl group having between about 12 and 16 carbon atoms.

16. A method according to claim 15 wherein two the R groups of said surfactant are selected from methyl and ethyl, and one R group is selected from ⊙—$CH_2$— and ⊙—$CH_2$—$C_2$—.

17. A method according to claim 15 wherein the cationic surfactant is an alkyl dimethyl ammonium chloride or a mixture of alkyl dimethyl ammonium chlorides.

* * * * *